United States Patent [19]

Schnell

[11] 4,079,794

[45] Mar. 21, 1978

[54] CYLINDER PIECE FOR A PILE DRIVING RAM

[75] Inventor: Hans Günther Schnell, Hamburg, Germany

[73] Assignee: Van Kooten, B.V., Naarden, Netherlands

[21] Appl. No.: 739,273

[22] Filed: Nov. 5, 1976

[30] Foreign Application Priority Data

Nov. 17, 1975 Netherlands ..... 7513421

[51] Int. Cl.[2] ..... E02D 7/14

[52] U.S. Cl. ..... 173/134; 92/161; 92/169; 123/46 H; 29/156.4 WL

[58] Field of Search ..... 173/127, 134–137; 123/46 H, 46 SC; 92/161, 169; 61/53.5

[56] References Cited

U.S. PATENT DOCUMENTS

| | | | |
|---|---|---|---|
| 3,679,005 | 7/1972 | Inaba et al. | 173/137 |
| 3,788,402 | 1/1974 | Chelminski | 173/135 |

FOREIGN PATENT DOCUMENTS

| | | | |
|---|---|---|---|
| 1,046,396 | 12/1958 | Germany | 92/169 |
| 2,522,204 | 4/1975 | Germany | 61/53.5 |

*Primary Examiner*—Ernest R. Purser
*Attorney, Agent, or Firm*—Lewis H. Eslinger

[57] ABSTRACT

A cylinder piece for a cylinder of a pile driving ram comprises inlet and outlet ports and at least two guide girdles for supporting guide members adapted to co-operate with a guide stay of a guide frame.

This considerable cylinder piece can be readily made in such a way that the possibility of unexpected damage is reduced and that it has a long lifetime, in that a core of the cylinder piece is made from ferritic-perlitic nodular cast iron with at least two substantially cylindrical guide girdle faces for guide girdles and in that at least two guide girdles are clamped around the guide girdle faces, which guide girdles are each mainly formed by a ring from predominantly ferritic nodular cast iron with a cylindrical bore.

9 Claims, 8 Drawing Figures

FIG.2
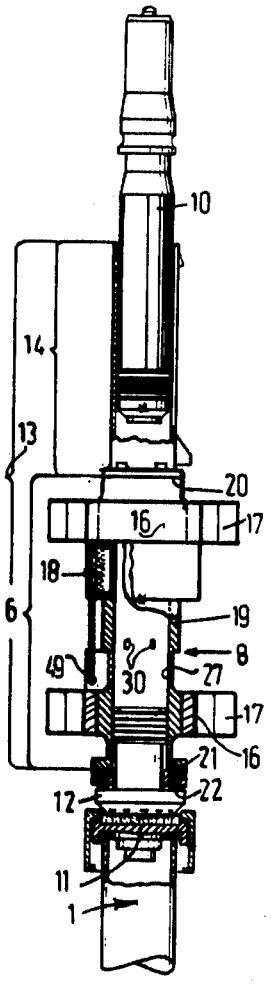
FIG.1
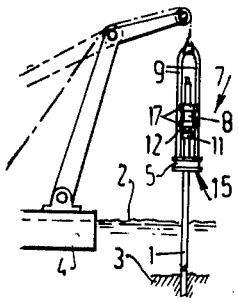
FIG.5
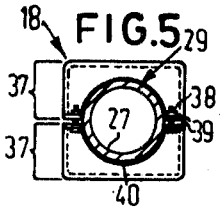
FIG.3
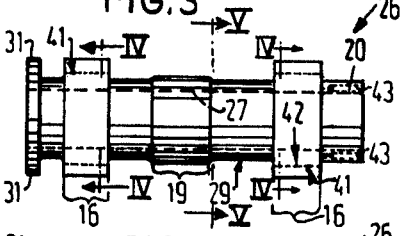
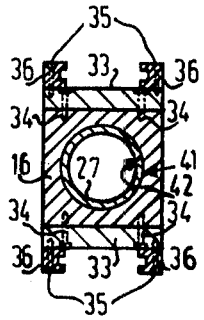
FIG.4
FIG.6
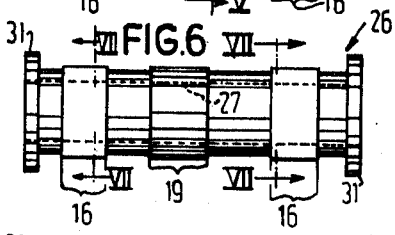
FIG.7
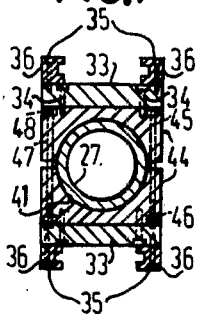
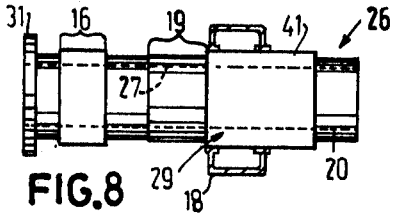
FIG.8

CYLINDER PIECE FOR A PILE DRIVING RAM

The invention relates to a cylinder piece for the cylinder of a pile driving ram, said cylinder being provided with inlet and outlet ports and at least two guide girdles for supporting guide members adapted to co-operate with at least one guide stay of a guide frame.

Such a cylinder piece is known and is employed particularly in a ram for driving piles into subaqueous ground, during which a heavy piston operating as a hammer is each time lifted by fuel explosion in a cylinder, part of which is formed by said cylinder piece. Such a cylinder piece is bulky, it may have a diameter of 0.5 or even 1 meter and a length of, for example, 6 meters, so that it is very expensive. The known cylinder piece has to be made in a particular difficult way, in that it has owing to the guide girdles a hollow shape with strongly different wall thickness, which can be difficultly cast. The mechanical load of the cylinder piece, also due to the usually rough handling in pile driving, is very high and hence the life-time of the known cylinder piece is short. It may occur that during the driving operation the cylinder piece is unexpectedly broken up so that the job is seriously delayed. In a known cylinder piece the guide girdles are united together with a cylindrical core to a monolith by casting. Another known cylinder piece is formed by parts which are united to one another by welding, part of which is formed by the guide girdles. During the welding operation there exist tensions in the cylinder piece, due to which the life-time of the cylinder piece is shortened.

The invention has for its purpose to provide a cylinder piece of the above mentioned kind, which can be readily made in such a way that the possibility of unexpected damage is reduced and which has a long lifetime. To this end a core of the cylinder piece according to the invention is made from ferritic-perlitic nodular cast iron with at least two substantially cylindrical guide girdle faces for guide girdles and at least two guide girdles are clamped around the guide girdle faces, which guide girdles are each mainly formed by a ring from predominantly ferritic nodular cast iron with a cylindrical bore. This core can be readily prepared in a sufficiently strong way by casting, possibly followed by heat treatments, because due to the not too unequal and not too large wall thickness the cooling and possible other heat treatments are nearly uniform at all places of the cylinder, so that the material construction over the complete core is nearly homogeneous. Furthermore the guide girdles can be firmly arranged on the core without difficulty. The material of the core has the hardness required for a combustion cylinder, whereas the material of the guide girdles is relatively soft and tough.

Each guide girdle can be shrunk around a guide girdle face or each guide girdle can be divided in an axial direction and can be clamped around a guide girdle face by clamping means.

If each guide girdle has a substantially square or rectangular circumference, the guide members can be firmly arranged about the guide girdles without difficulty.

If the core is made with at least one mainly cylindrical tank girdle face for supporting an annular tank, the tank for receiving fuel can be simply attached to the same, for example by shrinking operation or by dividing the tank in an axial direction and by arranging the tank around the tank girdle face.

If the outer diameter of at least one guide girdle face is larger than the outer diameter of an annular port girdle for the inlet and outlet ports and larger than that of at least one of the two ends of the cylinder piece, the method of shrinking may be applied for attaching the guide girdles.

The invention will be described more fully hereinafter with reference to a drawing.

In the drawing:

FIG. 1 is a schematic survey of the operation of a pile driving system equipped with a cylinder piece in accordance with the invention, FIG. 2 is an enlarged vertical sectional view of the cylinder piece of FIG. 1 bearing on a pile, FIG. 3 is a side view of the cylinder piece in accordance with the invention, FIG. 4 is a sectional view taken on each of the lines IV—IV of FIG. 3 in the mounted state of the cylinder piece, FIG. 5 is a sectional view taken on the line V—V in FIG. 3 in the mounted state of the cylinder piece, FIGS. 6 and 8 are each elevational views corresponding with FIG. 3 of different cylinder pieces in accordance with the invention, and FIG. 7 is a sectional view taken on each of the lines VII—VII in FIG. 6 in the mounted state of the cylinder piece.

By means of a floating derrick 4 a pile driving device 7 is arranged on a pile 1 to be driven in a ground 3 beneath the water 2. This pile driving device 7 comprises a guide frame 15 comprising a foot 5 engaged around the pile 1 and two guide stays 9 secured thereto. The pile driving device 7 comprises furthermore a ram 8 guided along the guide stays 9 by means of guide members 17 and a driving head 11 bearing on the pile 1.

FIG. 2 shows that the ram 8 comprises a cylinder 13 having a top portion 14 and a cylinder piece 6 in accordance with the invention. In the cylinder 13 are guided a piston 10 operating like a hammer and an impact member 12 bearing on the driving head 11.

The cylinder piece 6 comprises two guide girdles 16 for supporting the guide member 17 and supports an annular tank 18. Moreover the cylinder piece 6 has a port girdle 19 having ports 30 for admitting air and expelling exhuast gases. At the top end the cylinder piece 6 has a connecting rim 20, to which the top portion 14 is secured by bolts and at the lower end it has a connecting rim 21 for a bottom ring 22 of the cylinder piece 6.

A mainly cylindrical core 26 and the guide girdles 16 are manufactured separately in accordance with the invention. Referring to FIGS. 3 to 5 the core 26 has a cylindrical bore 27, two formed cylindrical guide girdle faces 41, a cylindrical tank girdle face 29, a formed port girdle 19, a formed flange 31 for securing the cylinder piece 6 to the bottom ring 22 and to a connecting rim 20 having a thick wall and axial bores 43 for bolts for securing the cylinder piece 6 to the top portion 14 (see FIG. 2). Each guide girdle 16 comprises a ring with a bore 42, which is shrunk around a cylindrical guide girdle face 41 (see FIG. 4). In order to allow homing of the guide girdles 16, the diameter of the bore of the hot guide girdle 16 is larger than that of the port girdle 19, the guide girdle faces 41 and the connecting rim 20. In order to facilitate slipping on the outer diameter of each guide girdle face is preferably larger than the outer diameter of the port girdle 19 and the connecting rim 20 and larger than the outer diameter of the connecting rim 20. The guide girdles 16 each support two spacer members 33 fastened thereto by means of countersunk bolts 34 and guide members 36 secured thereto by means of countersunk bolts 35 and having a U-shaped section.

The tank 18 is axially divided into halves 37, which are clamped together around the cylindrical tank girdle face 29 by means of clamping bolts 38 engaging flanges 39. Between the flanges 39 and around the tank girdle face 29 sealing strips 40, for example, of Teflon, are provided. If desired, the tank 18 may be divided axially into more than two parts.

The port girdle 19 has inlet and outlet ports 30 for admitting fresh combustion air and expelling exhaust gases.

The core 26 of FIGS. 6 and 7 differs from that of FIG. 3 in that the guide girdles 16 are each divided in an axial direction into guide girdle halves 44, which are clamped around a guide girdle face 41 by means of clamping means comprising clamping bolts 45 and nuts 46. The clamping bolts 45 extend in bores 47, whereas the bolt knobs 48 and the nuts 46 are countersunk.

The core 26 of FIG. 8 differs from that of FIG. 3 only in that it is provided with a tank girdle face 29 having the same diameter as the guide girdle faces 41. An annular tank 18 can be shrunk onto this tank girdle face 29.

It should be noted, that the tank 18 need not necessarily be secured to the cylinder piece 6. As an alternative, a fuel pump 49 fastened to the ram 8 may be fed through a hose (not shown) from a fuel tank (not shown) arranged, for example, on board the derrick 4.

In accordance with the invention the cylinder piece 6 is manufactured from ferritic-perlitic nodular cast iron, particularly from material which is indicated in DIN 1693 as GGG60 or GGG50, or which has the trade indication GN 50, the two latter of which being preferred.

On the contrary, the guide girdles and preferably also the tank are made from ferritic nodular cast iron, particularly from material which is indicated in DIN 1693 as GGG 35.3, GGG 40.3 or GGG 40. Preferably the material is employed which has the trade indication GN 38. The properties of these materials are given in the following table.

| nodular cast iron | | | | |
|---|---|---|---|---|
| indication | tensile strength kg/mm² | elasticity margin kg/mm² | hardness HB 30 kg/mm² | elasticity % |
| GGG 35.3 | 35 | 22 | 130–160 | 22 |

-continued

| nodular cast iron | | | | |
|---|---|---|---|---|
| indication | tensile strength kg/mm² | elasticity margin kg/mm² | hardness HB 30 kg/mm² | elasticity % |
| GGG 40.3 | 40 | 25 | 130–170 | 18 |
| GGG 40 | 40 | 25 | 140–200 | 15 |
| GN 38 | 38 | 25 | <180 | 17 |
| GGG 50 | 50 | 32 | 150–240 | 7 |
| GGG 60 | 60 | 38 | 175–290 | 3 |
| GN 50 | 50 | 35 | 170–240 | 7 |

What I claim is:

1. A cylinder piece for the cylinder of a pile driving ram, comprising a hollow cylinder having inlet and outlet ports formed therein and at least two guide girdles mounted thereon for supporting guide members adapted to co-operate with at least one guide stay of a guide frame, said cylinder comprising a hollow cylindrical core having at least one pair of substantially cylindrical guide girdle faces formed thereon, on which said guide girdles are mounted, said core of the cylinder being formed of ferritic-perlitic nodular cast iron and said at least two guide girdles being respectively clamped around said guide girdle faces, said guide girdles being formed of predominantly ferritic nodular cast iron with a cylindrical bore receiving and surrounding their associated guide girdle faces.

2. A cylinder piece as claimed in claim 1, wherein each guide girdle is divided in an axial direction and is clamped around a guide girdle face by clamping means.

3. A cylinder piece as claimed in claim 1, wherein each guide girdle is shrunk around a guide girdle face.

4. A cylinder piece as claimed in claim 1, wherein each guide girdle has a substantially square circumference.

5. A cylinder piece as claimed in claim 1, wherein said core is formed with at least one mainly cylindrical tank girdle face for supporting an annular tank.

6. A cylinder piece as claimed in claim 5, including an annular tank shrunk around said tank girdle face.

7. A cylinder piece as claimed in claim 6 wherein said tank is divided in an axial direction and is arranged around the tank girdle face.

8. A cylinder piece as claimed in claim 1, wherein said cylinder includes an annular port girdle between said guide girdle surfaces, said port girdle having said inlet and outlet ports formed therein and the outer diameter of at least one of the guide girdle faces being larger than the outer diameter of said annular port girdle and larger than that of at least one of the two ends of the cylinder piece.

9. A cylinder as claimed in claim 1, wherein each guide girdle has a substantially rectangular circumference.

* * * * *